US006217318B1

(12) United States Patent
De Giovanni Pache De Faria et al.

(10) Patent No.: US 6,217,318 B1
(45) Date of Patent: Apr. 17, 2001

(54) GRATE BAR FOR PELLETIZING AND SINTERING FURNACES

(75) Inventors: Marcelo De Giovanni Pache De Faria, Ilha Bela - Vitória - Espírito Santo (BR); José Fernando Leite Marques, Jabour - Vitória -Espírito Santo (BR)

(73) Assignee: Companhia Vale Do Rio Doce, Minas Gerais (BR)

( * ) Notice: Subject to any disclaimer, the term of this patent is extended or adjusted under 35 U.S.C. 154(b) by 0 days.

(21) Appl. No.: 09/326,113

(22) Filed: Jun. 4, 1999

(30) Foreign Application Priority Data

Mar. 2, 1999 (BR) ..... 7900232 U

(51) Int. Cl.[7] ..... F27B 9/26

(52) U.S. Cl. ..... 432/137; 126/167; 126/152 R

(58) Field of Search ..... 432/137; 110/267, 110/268, 327, 328; 126/152 B, 152 R, 167, 168, 179; D15/144

(56) References Cited

U.S. PATENT DOCUMENTS

| | | | | |
|---|---|---|---|---|
| 4,002,148 | * | 1/1977 | Harding | 126/174 |
| 4,610,209 | * | 9/1986 | Temelli | 126/168 |
| 5,081,939 | * | 1/1992 | Esser | 126/167 |
| 5,245,983 | * | 9/1993 | Krieger | 126/167 |

* cited by examiner

*Primary Examiner*—Denise L. Ferensic
*Assistant Examiner*—Gregory A. Wilson
(74) *Attorney, Agent, or Firm*—Helfgott & Karas, P.C.

(57) ABSTRACT

"AN IMPROVEMENT IN A GRATE BAR FOR PELLETIZING AND SINTERING FURNACES" comprised of a single body (10) provided with a higher horizontal girder (1) of rectangular cross-section supported in its ends by I-shaped legs (2) which are provided in their higher and lower edges, respectively, with an inverted V-shaped rim (3) and a square shoe (4); under the horizontal girder (1) a sub-girder (5) of an isosceles triangle cross-section is defined, the sides of which smoothly match with the sides of the girder (1) and make out a lower apex that defines a sharp edge pointing downwards referred to escape edge 7; wherein two transverse spacers (6) of rectangular cross-section also having escape edges (11) are provided adjacent to the girder (1).

7 Claims, 2 Drawing Sheets

GRATE BAR FOR PELLETIZING AND SINTERING FURNACES

FIELD OF THE INVENTION

The present specification refers to an improvement in a grate bar for pelletizing and sintering furnaces in order to attain a structural design provided with aerodynamic principles that allow for the reduction of the gas flow resistance and make it possible to reduce the bar mass so that each part may have the dimension required to perform the relevant function.

BACKGROUND OF THE INVENTION

Grate bars showing some structural features for attaining a better permeability with respect to the traditional shape of bars, thus aiming at increasing the gas passage area, are already commercially known and used.

Generally, such conventional bars have rectangular profiles including only short radiuses for rounding the edges. Said conventional construction shows some shortcomings, among which we have the fact that, in the event of a downward gas flow, when it passes through the slot between the bars there is an abrupt expansion of the section that causes a whirling after the lower bar edges with the consequent energy loss.

Another shortcoming of said conventional construction is related to the fact that the mass of the bars causes a thermal loss when the bars leave the furnace outlet and return cold to the inlet thereof.

Another shortcoming of said conventional construction is related to the fact that the whirling and the passageway area limitation cause a load loss between 9 and 14% of the total load loss of the pellet bed plus the bars in the burning area.

On trying to minimize such problems, that is, to generate a higher permeability to the gas flow, studies have shown the importance of an improvement in the design of the grate bar, including a lower cost.

Within this expectation, there appeared a new sound proposal for a grate bar provided with spacers below the bar higher face (thus expanding the length of the slot) with just one central spacer having a higher width and therefore with a greater number of slots.

OBJECTS OF THE INVENTION

Therefore, one of the objects of the present invention is to provide an improvement in a grate bar for pelletizing and sintering furnaces provided with innovating aerodynamic concepts in the structural conception thereof, thus being different from the conventionally known bars.

Another object of the present invention is to provide an improvement in a grate bar for pelletizing and sintering furnaces including an aerodynamic design and a mass only necessary to execute the functions for the performance of the bar.

Another object of the present invention is to provide an improvement in a grate bar for pelletizing and sintering furnaces that increases the permeability, thus making it possible to reduce the electric power consumption for maintaining the required gas flow in the process.

Another object of the present invention is to provide an improvement in a grate bar for pelletizing and sintering furnaces which allows for a production increase without the need to invest in the remodeling of the ventilation system.

Another object of the present invention is to provide an improvement in a grate bar for pelletizing and sintering furnaces which, with the mass reduction, brings about a decrease in the price of each bar as well as a reduction in the furnace heat power consumption.

These and other objects and advantages of the present invention are attained by an improvement in a grate bar for pelletizing and sintering furnaces comprised of a single body provided with escape edges (sharp edges) in the central spacers thereof; also comprised of a lower escape edge in the central portion of its body; wherein the latter is provided with a rounded section of its upper and lower side spacers, thus matching with the side of the grate bar beam; said single body having a greater higher length of its slot and a greater lower length between its "legs"; said "legs" bringing about a reduction in the side section and a mass reduction in the higher and lower side spacers of said bar.

BRIEF DESCRIPTION OF THE DRAWINGS

The present invention shall be described below by reference to the accompanying drawings, wherein.

DETAILED DESCRIPTION OF THE PREFERRED EMBODIMENTS

Figure 4:
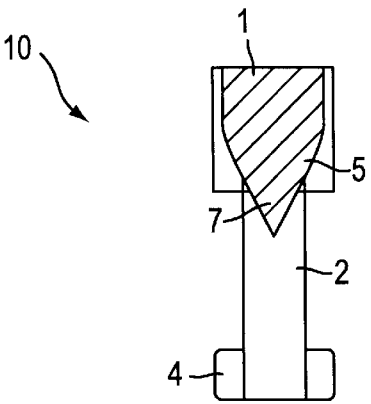
FIG. 4 shows a cut view of the improved grate bar taken along line "C—C" of FIG. 1.
Figure 6:
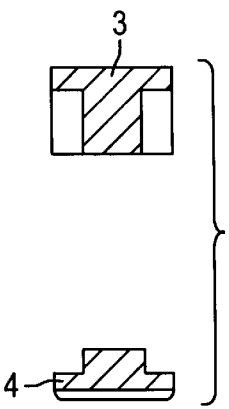
FIG. 6 shows a cut view of the improved grate bar taken along line "E—E" of FIG. 1.

According to these figures, the improvement in a grate bar for pelletizing and sintering furnaces is comprised of a single body 10 provided with a higher horizontal girder 1 of rectangular cross-section supported in its ends by I-shaped legs 2 which are provided in their higher and lower edges, respectively, with an inverted V-shaped rim 3 and a square shoe 4; under the horizontal girder a sub-girder 5 of an isosceles triangle cross-section is defined, the sides of which smoothly match with the sides of girder 1 and make out a lower apex that defines a sharp edge pointing downwards referred to as escape edge 7. The cross-sections of girder 1 and sub-girder 5 integral therewith are constant as shown by broken lines in FIG. 4, being changed only in the intersections with central spacers 6 and support legs 2.

Figure 2:
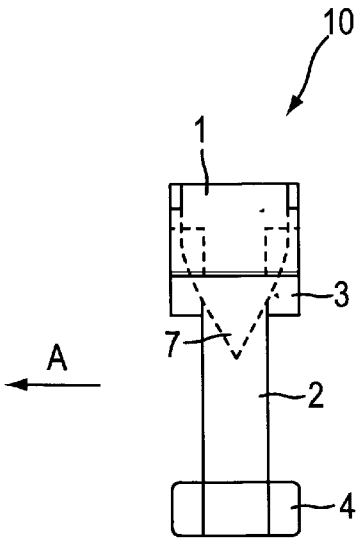
FIG. 2 is a longitudinal view of the grate bar for pelletizing and sintering furnaces taken according arrow "A" of FIG. 1.
Figure 1:
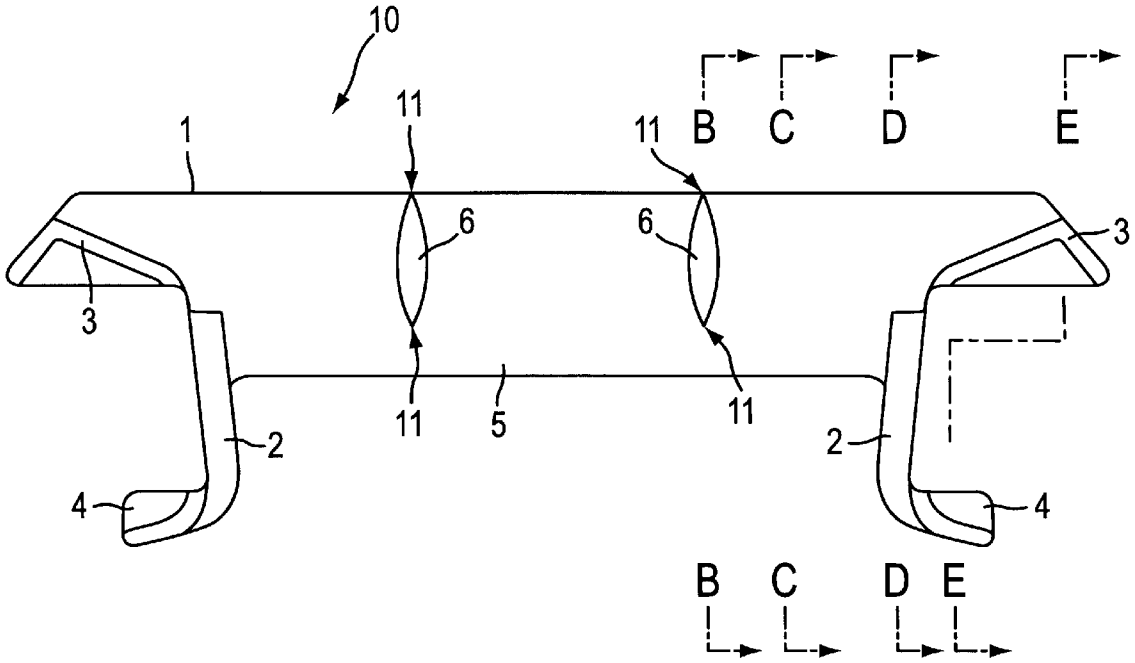
FIG. 1 is a front view of the improved grate bar.
Figure 3:
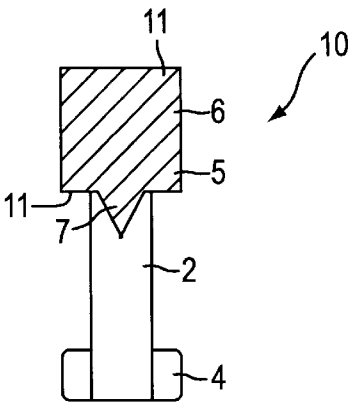
FIG. 3 shows a cut view of the improved grate bar taken along line "B—B" of FIG. 1.
Figure 5:
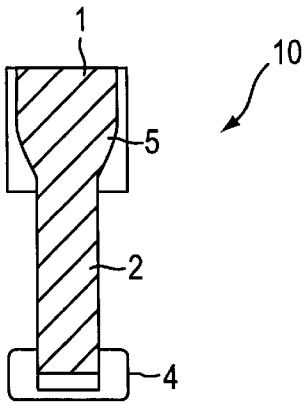
FIG. 5 shows a cut view of the improved grate bar taken along line "D—D" of FIG. 1.

In the mean portion of the single body 10, adjacent to girder 1, two transverse spacers 6 of a rectangular cross-section having escape edges 11 as is illustrated in FIGS. 1 and 3 are provided.

Thus, with this aerodynamic configuration, the improved grate bar for pelletizing and sintering furnaces shows escape edges (sharp edges) in the central spacers thereof; as well as embodies a lower escape edge in the central portion of its body; the latter having a rounded section in its higher and lower side spacers that match with the side of the grate bar beam; said single body 10 having a greater higher length of its slot and a greater lower length between its legs 2; which bring about a reduction in the cross-section and a reduction in the mass of the higher and lower side spacers of said bar.

Despite the fact that a preferred embodiment has been described and illustrated, it should be stressed that the improvement in a grate bar for pelletizing and -sintering furnaces may be subject to structural changes without departing from the scope of the present invention.

What is claimed is:

1. "AN IMPROVEMENT IN A GRATE BAR FOR PELLETIZING AND SINTERING FURNACES" comprised of a single body (10) provided with a higher horizontal girder (1) of rectangular cross-section supported in its ends by I-shaped legs (2) which are provided in their higher and lower edges, respectively, with an inverted V-shaped rim (3) and a square shoe (4); under the horizontal girder (1) a sub-girder (5) of an isosceles triangle cross-section is defined, the sides of which smoothly match with the sides of the girder (1) and make out a lower apex that defines a sharp edge pointing downwards referred to as escape edge 7; wherein two transverse spacers (6) of rectangular cross-section also having escape edges (11) are provided adjacent to the girder (1).

2. "AN IMPROVEMENT IN A GRATE BAR FOR PELLETIZING AND SINTERING FURNACES" according to claim 1, wherein the bar (10) is provided with escape edges (sharp edges) (11) in its central spacers (6); as well as a lower escape edge (7) in the central portion of its body along the sub-girder girder (5) incorporated to the girder (1) of the body (10).

3. "AN IMPROVEMENT IN A GRATE BAR FOR PELLETIZING AND SINTERING FURNACES" according to claim. 1, wherein the sub-girder (5) incorporated to the girder (1) has a rounded section in its higher and lower side spacers.

4. "AN IMPROVEMENT IN A GRATE BAR FOR PELLETIZING AND SINTERING FURNACES" according to claim 1, wherein said single body (10) has a greater higher length in its slot and a greater lower length between its legs (2); which bring about a reduction in the mass of the higher and lower spacers of said bar.

5. "AN IMPROVEMENT IN A GRATE BAR FOR PELLETIZING AND SINTERING FURNACES" according to claim 1, wherein there are more than two central spacers (6).

6. "AN IMPROVEMENT IN A GRATE BAR FOR PELLETIZING AND SINTERING FURNACES" according to claim 1, wherein the legs (2) are replaced by another system.

7. "AN IMPROVEMENT IN A GRATE BAR FOR PELLETIZING AND SINTERING FURNACES" according to claim 1, wherein the bar is comprised of a plurality of parts (10) connected to one another.

* * * * *